United States Patent [19]

Pong et al.

[11] 4,418,846

[45] * Dec. 6, 1983

[54] AEROSOL DISPENSING SYSTEM

[75] Inventors: Richard G. S. Pong, Passaic Park; Arun Nandagiri, Dover; Oleh M. Bilynskyj, East Hanover; Le Roy Hunter, Randolph, all of N.J.

[73] Assignee: American Cyanamid Company, Stamford, Conn.

[ * ] Notice: The portion of the term of this patent subsequent to Aug. 16, 2000 has been disclaimed.

[21] Appl. No.: 221,234

[22] Filed: Dec. 29, 1980

Related U.S. Application Data

[63] Continuation-in-part of Ser. No. 136,206, Apr. 1, 1980, abandoned, which is a continuation-in-part of Ser. No. 84,687, Oct. 15, 1979, abandoned, which is a continuation-in-part of Ser. No. 973,261, Dec. 26, 1978, abandoned.

[51] Int. Cl.[3] ..... B67D 5/58

[52] U.S. Cl. ..... 222/189; 222/402.1; 222/464

[58] Field of Search ..... 222/189, 211, 464, 402.1, 222/402.18, 402.2; 239/337, 340, 372; 55/159, 528

[56] References Cited

U.S. PATENT DOCUMENTS

| | | | |
|---|---|---|---|
| 2,681,252 | 6/1954 | Tuttle | 239/337 |
| 2,995,278 | 8/1961 | Clapp | 239/337 |
| 3,523,408 | 8/1970 | Rosenberg | 55/159 |

*Primary Examiner*—H. Grant Skaggs
*Attorney, Agent, or Firm*—Charles J. Fickey

[57] ABSTRACT

A dispenser comprising valve means and tubular diptube means is disclosed wherein the diptube has an open end, is in fluid communication with the valve means and is formed of a lipophilic material having multidirectional pores randomly distributed throughout its mass.

13 Claims, 5 Drawing Figures

AEROSOL DISPENSING SYSTEM

CROSS-REFERENCE TO RELATED APPLICATIONS

This application is a continuation-in-part of application Ser. No. 136,206, filed Apr. 1, 1980, now pending which, in turn, is a continuation-in-part of application Ser. No. 84,687, filed Oct. 15, 1979 and now abandoned, which, in turn, is a continuation-in-part of Ser. No. 973,261, filed Dec. 26, 1978, and now abandoned.

BACKGROUND OF THE INVENTION

The use of pressurized containers to dispense a wide variety of substances such as paint, cleaners etc. has been practiced for many years. Gaseous propellants such as the fluorocarbons, hydrocarbons, (condensed gases) or carbon dioxide (compressed gas) and the like have all been used for this purpose. Generally, in these systems, the material to be dispensed, if a solid such as in an antiperspirant, is suspended in a liquified propellant and is dispensed by the gaseous propellant. When the material to be dispensed is a liquid, it is either dispensed by the gaseous propellant as a single liquid phase having the liquified propellant dissolved therein or as a liquid per se with no liquified propellant. Usually, a valved eduction tube, open at its bottom, provides a passageway for the gaseous propellant to force the material to be dispensed upwardly therethrough and out of the container in which it is packaged. Systems of this type are known as two-phase systems, phase I being an upper layer of gaseous propellant and phase II being a liquid or a solid suspended in a liquid.

If, however, the material to be dispensed is of the nature of two immiscible liquids, for example, an aqueous solution and a liquified hydrocarbon propellant, difficulty is encountered. Such systems additionally contain a gaseous propellant and hence are known as three-phase systems. It has been found that conventional valve/diptube assemblies are incapable of dispensing properly the material to be dispensed uniformly from beginning to end when three-phase systems are involved. In a three-phase system, phase I is a gaseous propellent and phases II and III are two immiscible liquids, one of which may be a liquified propellant. An example of three-phase system is an aqueous solution of the material to be dispensed, phase I, a liquified hydrocarbon propellant, phase II, and gaseous hydrocarbon propellant, phase II.

In the dispensing of three-phase systems, conventionally, an aerosol valve at the top of a container is fitted with an eduction tube (or diptube) extending to a point near the inside bottom of the container and into the material to be dispensed. The material to be dispensed flows upwardly through the eduction tube under the influence of the internal can pressure in the valve housing and is dispensed through the valve button. A vapor tap, which usually opens into the body of the valve to mix gaseous propellant with the material stream, may also be included in the device.

Technology is available to formulate aerosol products, including such items as hair sprays, as solutions in water or in water-alcohol solutions, in which hydrocarbon propellants are insoluble. The problem with the use of such products is that because they are three-phase systems, their delivery by aerosol dispensing techniques is inadequate. One technique for handling such systems is described in U.S. Pat. No. 3,260,421.

If a dispensing technique which is more effective than those existing commercially at the present time could be devised, it would satisfy a long-felt need.

BRIEF DESCRIPTION OF THE DRAWINGS

The means provided by the present invention may comprise various adaptations as shown in the accompanying drawings.

SUMMARY OF THE INVENTION

Figure 1:
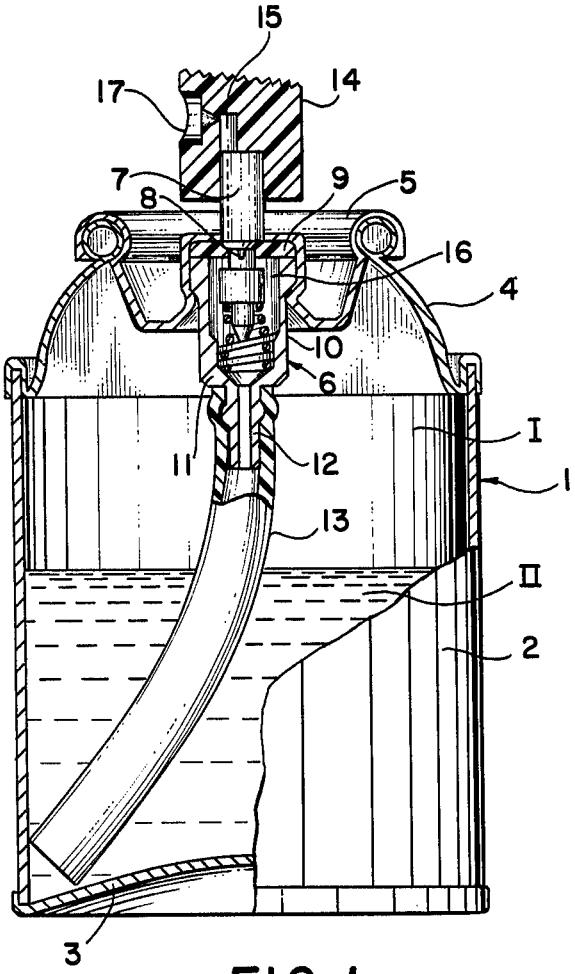
PRIOR ART FIG. 1
FIG. 1 is a side-sectional, diagramatic view of the prior art pressurized aerosol container for use with two-phase systems.

It has now been found that three-phase systems can be dispensed as aerosols by employing a diptube or eduction tube produced from a material which is lipophilic and has multidirectional pores randomly distributed throughout its mass. The new dispensers and aerosol assemblages of the present invention enable the dispensation of three-phase systems as fine mists and therefore overcome many of the disadvantages of prior art dispensers.

DESCRIPTION OF THE INVENTION INCLUDING PREFERRED EMBODIMENTS

In accordance with the present invention there is provided a dispenser adapted to dispense a pressurized aerosol comprising a valve means and a tubular diptube means, said tubular diptube having an open lower end and being (1) in fluid communication with said valve means and (2) formed of a lipophilic material having multidirectional pores randomly distributed throughout at least a substantial portion or all of its mass, characterized in that said pores permit the preferential passage of lipophilic liquid therethrough.

There is also provided herein, an aerosol assemblage comprising (A) a closed container, (B) a valve means positioned in the upper end of said container and (C) a tubular diptube means, said tubular diptube means having a lower open end and being (1) in fluid communication with said valve means and (2) formed of a lipophilic material having multidirectional pores randomly distributed throughout at least a substantial portion or all of its mass, characterized in that said pores permit the passage of lipophilic liquid therethrough.

More particularly, the dispenser and aerosol assemblage of the present invention provide for the dispensing of two immiscible liquid phases in a three-phase system also containing gaseous propellant phase. In particular the two immiscible liquid phases are a lipophilic phase and a non-lipophilic phase, such as a hydrocarbon propellant phase and an aqueous or hydroalcoholic phase containing the material to be dispensed. When such a three-phase system is dispensed in accordance with the dispenser of the present invention, at least a part of the pores of the material from which the tubular diptube is constructed are in contact with the lipophilic phase thereby allowing the lipophilic liquid to preferentialy wet the diptube throughout its length. The diptube means is in fluid communication with a valve means i.e. liquid flowing through the diptube is communicated to the valve means so that the lipophilic liquid preferentilly passes through the pores of the tubular diptube means while the non-lipophilic phase, under the influence of the gaseous propellant passes upwardly through the open lower end of the diptube means. The lipophilic liquid is thereby combined with the non-lipophilic phase, pass through the valve means and are dispensed through the valve button.

The diptube means which forms part of the novel dispenser of the present invention is produced from a lipophilic polymer which is capable of being molded, cast, extruded or otherwise formed into a tubular shape. By the term "tubular", as used herein, is meant a circular, square, elliptical or any other shape cross-section capable of transporting liquid through the length of the diptube. The lipophilic materials which may be used for the construction of the tubular diptubes are well known to those skilled in the art and, in general, include the polyaklenes such as polystyrene, polyethylene, and the like as well as other polymers containing other substituents which do not detrimentally alter the lipophilic properties thereof. Examples of other polymers include the polycarbonates, polytetrafluoroethylene, polyvinylchloride and the like.

The tubular diptube should have a wall diameter ranging from about 0.05 to about 1.0 inch, preferably from about 0.1 to about 0.3 inch. It is essential that the diptube contains multidirectional pores throughout at least a substantial portion of its mass. By the term "multidirectional", as used herein, is meant circuitous, i.e. that the walls of the tubular diptube possess a multitude of passages which allow movement of a lipophilic liquid from the outer surface of the diptube means to the inner, hollow area thereof wherein it admixes with the liquid moving upwardly through the diptube.

The pore size of the diptube means should vary from about 0.1 to about 40 microns, preferably from about 4.0 to about 8.0 microns, and a pore density, which is a measure of pores per unit volume of from about 40 to about 80 percent, preferably from about 45 to about 75 percent, however, both the pore size and pore density may be higher or lower than the above ranges without distracting from the efficacy of the dispenser of the present invention. The pore size in each specific instance depends upon a number of factors, such as the cross-sectional open area of the diptube and the viscosity of the lipophilic phase. Generally, a cross-sectional open area ranging from about 0.0003 to about 0.085 sq. in., preferably from about 0.0007 to about 0.005 sq. in. has been found satisfactory for most lipophilic phases which are normally used. In one particular application, for example, a diptube having a 1/16 inch internal diameter was used with a hair spray concentrate wherein the non-lipophilic phase had a viscosity of about 7 centistokes. The pore size of the diptube was about 1–5 microns and the pore density was about 50–70%.

The material from which the diptube is formed may be prepared by a number of different methods well-known to the polymer art.

In one method, the material is made by casting a polymer solution. A solution of polymer, in which the compatibility of the solute and solvent is highly temperature dependent, is cast or extruded. The solvent separates from the solute to form globules suspended in a polymer—solvent matrix. Removal of the solvent yields the porous material. Pore size is determined by the solution behavior of the components used and the rate of cooling of the solution and ranges from about 0.1 to 11 microns.

In another method, the material is made by sintering plastic beads in molds. Beads of plastic are rounded (made spherical) and sorted for size. The pore size is determined by the bead size and typically ranges from about 10 to 30 microns and larger with normal techniques but may be reduced to 0.2 microns with special techniques.

A third method for making the material is by extrusion of a polymer with starch or salt which is then removed by extraction in a hot bath. When starch is used, hydrolysis to sugar is required by including acid in the extraction process. The side of the pores produced is dependent on the size of the salt or starch particles used and may range from 10 microns downward. The pore density may be varied as desired by varying the amount of the starch or salt.

After the porous material is prepared, the diptube means useful in the invention set forth herein is prepared therefrom in the manner described above.

In accordance with the present invention, when a three-phase system is contained in the aerosol assemblage, it appears that the lipophilic diptube means is preferentially wetted by the lipophilic liquid phase and the wetting action takes place substantially throughout the pores of the walls of the diptube. Once the diptube means is so wetted, it appears to substantially prevent the flow of both the gaseous propellant and the non-lipophilic phase through the pores thereof. Therefore, the diptube means is maintained in contact with the lipophilic liquid phase as completely as possible throughout the use of the aerosol assemblage.

Referring now to the drawings, FIG. 1 sets forth a conventional two-phase aerosol system having container 1 with body 2, bottom 3, collar 4 and top 5. Valve member 6 fits into top 5. The contents of container 1 are divided into two phases, an upper vapor phase I and a lower liquid phase II. Phase I is a gaseous propellant and phase II consists of a liquid propellant, which is under superatmospheric pressure, and in which there is dissolved or admixed, the product to be dispensed. Valve member 6 comprises a hollow stem with the valve 8 normally seated against gasket 9 by means of spring 10. Surrounding valve 8 is a housing 11 with a tailpiece 12 to which flexible diptube means 13 is attached. The valve stem 7 has actuator or head 14 mounted thereon with passageway 15 therethrough. When actuated by pressing head 14 downwardly, valve 8 moves downwardly to open interior cavity 16 of housing 11. Since vapor phase I and liquid phase II are under superatmospheric pressure, liquid phase II is forced up diptube 13 into passageway 15 where it becomes vaporized and leaves head orifice 17 as a fine spray.

Figure 2:
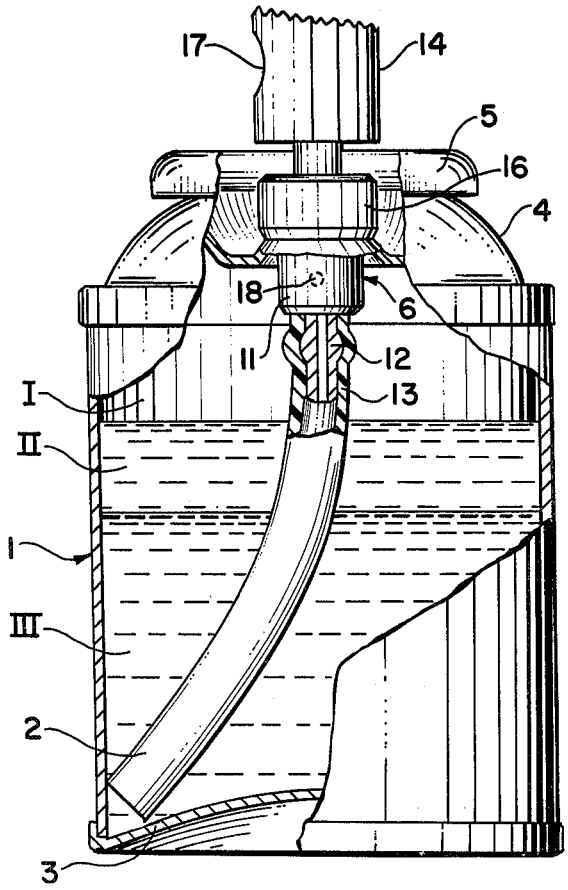
PRIOR ART FIG. 2
FIG. 2 is a side-sectional, diagramatic view of prior art pressurized aerosol container for use with a three-phase sytem.

In FIG. 2, there is shown a prior art aerosol system comprising container 1 of the same type as described above with reference to FIG. 1 wherein there is shown a three-phase system in which, for example, phase I is gaseous propellant, phase II is liquified propellant and phase III is a liquid product immiscible with and heavier than the phase II propellant. Phase II may comprise a hydrocarbon such as butane while phase III may be an aqueous or hydro-alcoholic solution of a resinous hair spray. When head 14 is depressed, phase III liquid rises up tube 13 into valve 6 but leaves orifice 17 as a liquid stream or poorly dispersed spray rather than a fine mist since there is no condensed propellant admixed therewith. In order to form a better spray mist, a tap 18 on housing 11 is added to admit aqueous propellant from phase I into body cavity 16 where it admixes with phase III liquid resulting in a better mist from orifice 17. A system of this type, however, has the disadvantage of an extremely low spray rate since the gaseous propellant tends to occupy most of the volume of the valve body.

In U.S. Pat. Nos. 3,113,698, 3,260,421 or 3,272,402 there are disclosed procedures for dispensing admixed liquid phases and non-miscible phases, however, these systems are very complex and expensive. The dispenser of the present invention accomplishes the mixing of liquid phase II and III by an entirely different and simpler principle.

Figure 3:
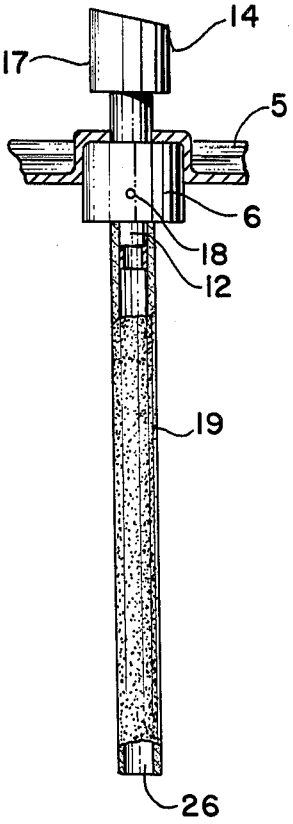
FIGS. 3 to 5 represent several alternative constructions for the valve and diptube assemblies of the present invention.

Referring now to FIG. 3 of the drawings, there is shown therein a dispenser according to the present invention which is useful in a three-phase aerosol system as shown in FIG. 2. Diptube means 19 is attached to tailpiece 12 of valve 6. Diptube means 19 is formed of a lipophilic porous material having multidirectional pores and which is permeable substantially only to liquid phase II which is also lipophilic and preferentially wets diptube means 19 when in contact therewith. Diptube means 19 is open at its lower end 26 and liquid phase III enters open end 26 when head 14 is depressed. The liquid propellant phase II permeates the walls of diptube means 19 and both phases admix inside diptube 19 and valve 6 whereby they are discharged from orifice 17 as a finely divided mist. As the product mixture of phase II and III is dispensed, the position of these phases in the container relative to diptube means 19 will change due to the depletion thereof. Since diptube means 19 is permeable substantially only to phase II along its entire length however, the aerosol assemblage will continue to function in the same manner.

Figure 4:
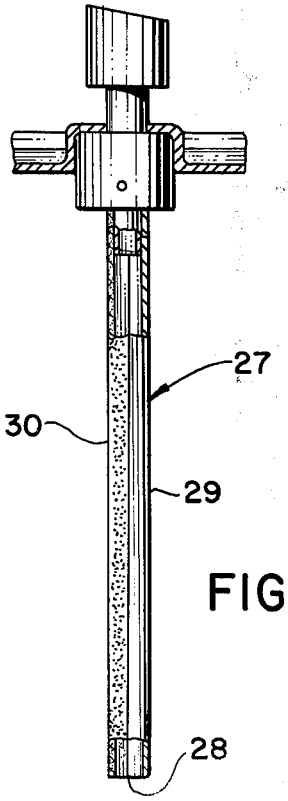

In FIG. 4, a diptube means 27 is provided which is open at the bottom 28 and has one side 29 impermeable to liquid phase II and liquid phase III and the other side 30 which is permeable to liquid phase II but impermeable to liquid phase III. Liquid product phase III enters means 27 through open bottom 28 and liquid propellant phase II enters the diptube 27 through permeable wall 30.

Figure 5:
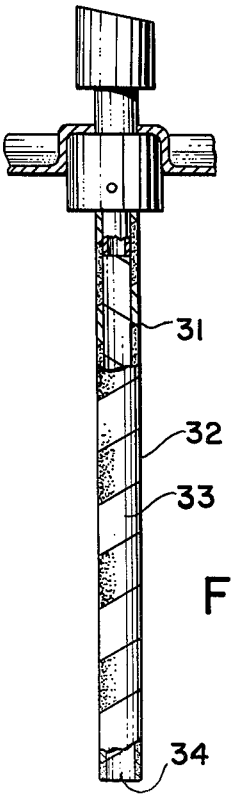

FIG. 5 is another variation of diptube means 19 of FIG. 3 and is similar to the embodiment shown in FIG. 4 except that the diptube means 31 consists of alternating spiral bands of a material 32 which is permeable to liquid phase II but not phase III and material 33 which is impermeable to both phases II and III. Liquid phase III enters through the open end 34 of means 31 and liquid phase II propellant enters through the multidirectional pores in material 32.

Diptube means as shown in FIGS. 4 and 5 may be prepared by using a lipophilic material having multidirectional pores therein such as polypropylene, and prepared as described above, and a second material such as non-porous polypropylene as the impervious portion thereof. The sections of material may be glued, sintered etc. or otherwise adhered together to form the ultimate diptube structure.

The lipophilic material which forms phase II of a three-phase system as used herein will generally comprise a liquid propellant but may comprise any material which generates pressure sufficient to operate the aerosol system and which is immiscible with liquid phase III which contains the material which is to be dispensed. The lipophilic propellant preferably is a liquified hydrocarbon or mixture of hydrocarbons or any other liquified compound which possesses propellant properties and preferentially wets the lipophilic portion of the diptube.

The dispenser and aerosol assemblage of the present invention may be used for the dispensing of many formulations in which either a water-soluble or oil-soluble material is to be dispensed. The examples are set forth hereinbelow are representative of the wide range of materials which may be dispensed in accordance with the instant invention, however, other materials may also be involved such as the codispensing of high water (18–40%) and high fragrance (5–25%) formulations; the dispensing of after-shave lotion of high water-low alcohol-fragrance content without any surfactant; the codispensing of oil and vinegar and the like.

EXAMPLE I

| Insecticide | % by/wt. |
|---|---|
| Pyrethrine | 0.25 |
| Iperonyl Butoxide | 1.25 |
| Fragrance | 0.20 |
| Petroleum Distillate | 1.25 |
| Deionized Water | 67.05 |
| Isobutane | 30.00 |
| | 100.00 |

EXAMPLE II

| Space Deodorant | % by/wt. |
|---|---|
| Perfume | 1.50 |
| Deionized Water | 73.50 |
| Isobutane | 25.00 |
| | 100.00 |

EXAMPLE III

| Antiperspirant | |
|---|---|
| Aluminum Chlorohydrol (Water-Soluble) | 15.00 |
| Perfume | 0.50 |
| Deionized Water | 44.50 |
| Ethyl Alcohol-190 proof | 15.00 |
| Isobutane | 25.00 |
| | 100.00 |

EXAMPLE IV

| Deodorant | % by/wt. |
|---|---|
| Ethyl Alcohol 190 proof | 20.00 |
| Perfume | 1.50 |
| Deionized Water | 53.50 |
| Isobutane | 25.00 |
| | 100.00 |

EXAMPLE V

| Hair Spray | |
|---|---|
| Ethyl Alcohol 190 proof | 43.72 |
| Gantrez 225 50% Alcohol solution* | 6.00 |
| Aminomethyl Propanol | 0.13 |

-continued

| Hair Spray | |
|---|---|
| Deionized Water | 25.00 |
| Perfume | 0.15 |
| Isobutane | 25.00 |
| | 100.00 |

*Copolymer of monoethyl ester of maleic acid and methyl vinyl ether

EXAMPLE VI

| Hair Spray | |
|---|---|
| Ethyl Alcohol | 46.38 |
| Methyl Methacrylate/ Methacrylic Acid 80:20 | 3.00 |
| Aminomethyl Propanol | 0.47 |
| Deionized Water | 30.00 |
| Fragrance | 0.15 |
| Isobutane | 20.00 |
| | 100.00 |

We claim:

1. A dispenser adapted to dispense a pressurized aerosol comprising a valve means and a tubular diptube means, said tubular diptube having an open lower end and being (1) in fluid communication with said valve means and (2) formed of a lipophilic material having multidirectional pores randomly distributed throughout at least a substantial portion of its mass, characterized in that said pores permit the passage substantially only of lipophilic liquid therethrough.

2. The dispenser of claim 1 wherein said lipophilic material is polyethylene.

3. The dispenser of claim 1 wherein said lipophilic material is polyethylene.

4. The dispenser of claim 1 wherein the diameter of the walls of said tubular diptube means ranges from about 0.05 to about 1.0 inches.

5. The dispenser of claim 1 wherein said tubular diptube has a cross-sectional open area ranging from about 0.0003 sq. in. to about 0.085 sq. in.

6. The dispenser of claim 1 wherein said material has a pore size of from about 0.1 to 40.00 microns.

7. The dispenser of claim 1 wherein said material has a pore density of about 40–80%.

8. An aerosol assemblage comprising (A) a closed container, (B) a valve means positioned in the upper end of said container and (C) a tubular diptube means, said diptube means having an open lower end and being (1) in fluid communication with said valve means and (2) formed of a lipophilic material having multi-directional pores randomly distributed throughout at least a substantial portion of its mass, characterized in that said pores permit the passage of substantially only lipophilic liquids therethrough.

9. An aerosol assemblage according to claim 8 wherein said lipophilic material is polyethylene.

10. An aerosol assemblage according to claim 8 wherein said lipophilic material is polyethylene.

11. An aerosol assemblage accordng to claim 8 wherein said tubular diptube has a cross-sectional open area ranging from about 0.0003 sq. in. to about 0.085 sq. in.

12. An aerosol assemblage according to claim 8 wherein said material has a pore size of from about 0.1 to 40 microns.

13. An aerosol assemblage according to claim 8 wherein said material has a pore density of about 40–80%.

* * * * *